US007753471B2

(12) United States Patent
Waller et al.

(10) Patent No.: US 7,753,471 B2
(45) Date of Patent: Jul. 13, 2010

(54) PRINTING MECHANISM AND METHOD

(75) Inventors: David J Waller, Vancouver, WA (US); Kris English, Clackamas, OR (US); Jim Plymale, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1272 days.

(21) Appl. No.: 10/780,169

(22) Filed: Feb. 17, 2004

(65) Prior Publication Data

US 2005/0179713 A1 Aug. 18, 2005

(51) Int. Cl.
*B41J 2/165* (2006.01)

(52) U.S. Cl. ..... 347/22; 347/32

(58) Field of Classification Search ..... 347/9, 347/22, 29, 30–34, 37, 39
See application file for complete search history.

(56) References Cited

U.S. PATENT DOCUMENTS 5,103,244 A 4/1992 Gast et al.
5,115,250 A 5/1992 Harmon et al.
5,257,044 A 10/1993 Carlotta et al.
5,325,151 A * 6/1994 Kimura et al. ..... 399/227
5,587,729 A * 12/1996 Lee et al. ..... 347/32
5,730,538 A 3/1998 Kato
5,907,334 A * 5/1999 Hirano et al. ..... 347/23
5,914,734 A * 6/1999 Rotering et al. ..... 347/28
6,015,202 A 1/2000 Hiramatsu et al.
6,164,754 A 12/2000 Ide et al.
6,172,691 B1 * 1/2001 Belon et al. ..... 347/32
6,196,653 B1 3/2001 Igarashi et al.
6,280,015 B1 8/2001 Nguyen et al.
6,328,412 B1 * 12/2001 Taylor et al. ..... 347/32
6,357,851 B1 * 3/2002 Gaasch ..... 347/33
6,447,094 B1 9/2002 Berg et al.
6,481,822 B2 11/2002 Murcia et al.
6,493,937 B1 12/2002 Axtell et al.
6,520,620 B1 2/2003 Askren et al.
2001/0033308 A1 10/2001 Fujimoto et al.
2002/0003553 A1 1/2002 Ng
2002/0015070 A1 2/2002 Taylor et al.
2002/0191043 A1 12/2002 Anderson et al.
2003/0001921 A1 * 1/2003 Simmons et al. ..... 347/32
2003/0007031 A1 1/2003 Sugiyama
2003/0169312 A1 * 9/2003 Ota et al. ..... 347/29
2004/0046826 A1 * 3/2004 Schalk et al. ..... 347/22
2004/0212656 A1 * 10/2004 Waller et al. ..... 347/33
2004/0252154 A1 * 12/2004 Griesemer et al. ..... 347/22

* cited by examiner

*Primary Examiner*—Julian D Huffman
*Assistant Examiner*—Jason S Uhlenhake

(57) ABSTRACT

One embodiment of a printhead servicing mechanism includes a driveshaft, and a sled including a rack adapted to selectively engage the driveshaft and a retaining wall positioned to retain the driveshaft on the rack in a zone.

52 Claims, 8 Drawing Sheets

PRINTING MECHANISM AND METHOD

BACKGROUND

Printing mechanisms, such as printers, may use one or more print cartridges, sometimes referred to as "pens," which may fire drops of liquid colorant, referred to generally herein as "ink," onto a page. Each print cartridge may have a printhead formed with very small nozzles through which the ink drops are fired. To print an image, the print cartridge carrying the printhead may be propelled back and forth across the page, firing drops of ink in a desired pattern as it moves. The particular ink ejection mechanism within the printhead may take on a variety of different forms known to those skilled in the art, such as those using piezo-electric or thermal printhead technology.

To clean the printhead, a "service station" mechanism may be mounted within the printer housing. Movement of the service station may be actuated by a dedicated motor. Such a dedicated motor may require space within the housing of the printing assembly which may increase the overall size of the printing assembly. Use of a dedicated motor may also increase the overall cost and power requirements of the printing assembly.

Therefore, for these and other reasons there is a need for the present invention.

DETAILED DESCRIPTION OF THE DRAWINGS

Figure 1:
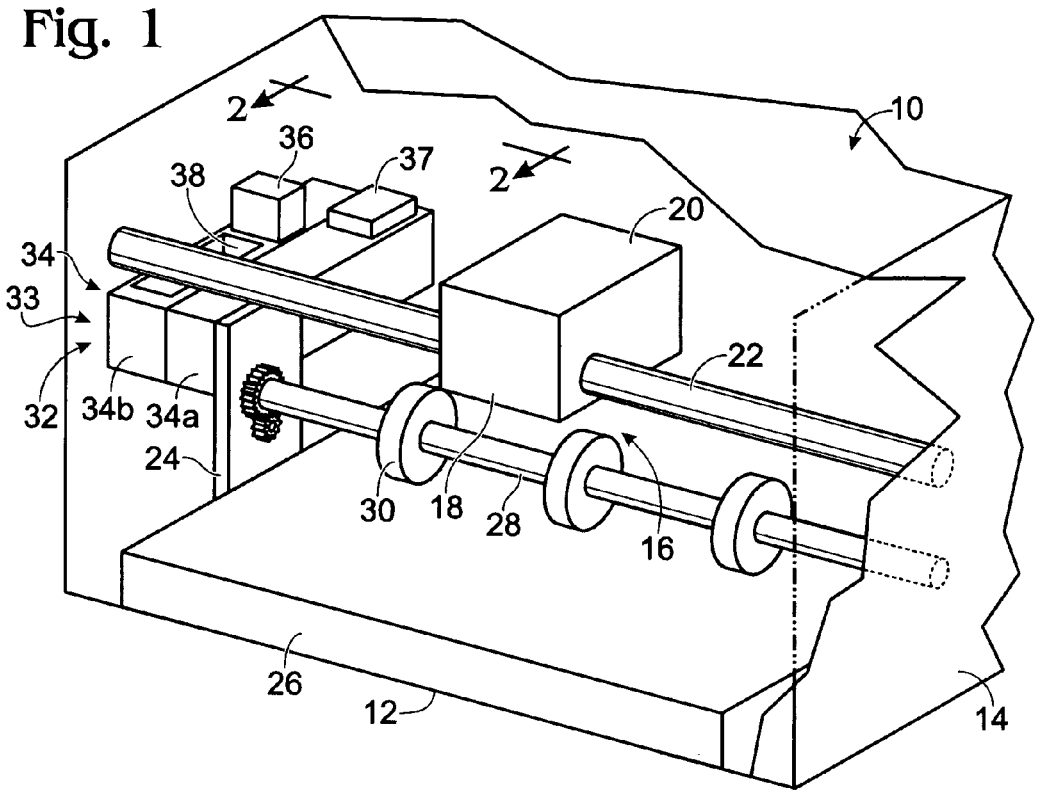
FIG. 1 is a front perspective view of one form of a printing mechanism including one embodiment of the printhead servicing mechanism of the present invention.

FIG. 1 illustrates one embodiment of a printing mechanism. The printing mechanism may be used for the printing of business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience, the concepts of example embodiments of the present invention are illustrated in the environment of an inkjet printer 10. However, other printing mechanisms may include embodiments of the present printhead servicing mechanisms.

While the printer's components may vary, printer 10 may include a base 12 surrounded by a housing 14. Base 12 may be manufactured of steel or the like whereas housing 14 may be manufactured of a plastic material. Sheets of print media may be fed through a printzone 16 to a printhead 18 which may be supported by a printhead carriage 20. Printhead carriage 20 may be movably mounted on a carriage rod 22 for movement there along, wherein carriage rod 22 may be mounted on a chassis 24 which may be secured to base 12. In this figure, printhead carriage 20 is shown positioned in printzone 16. The print media may be any type of suitable material, such as paper, card-stock, transparencies, mylar, and the like, but for convenience, the illustrated embodiment is described using a sheet of paper as the print medium. The printer 10 may include a feed tray 26 for storing sheets of print media before printing thereon. One or more motor-driven drive shafts 28, which may have one or more drive rollers 30 mounted thereon, may be used to move the print media from tray 26 into printzone 16 for printing. During operation of printer 10, printhead 18 may be moved into a servicing region 32 which may include a printhead servicing mechanism 33 including a servicing sled 34. In a preferred embodiment, servicing sled 34 may include a first sled 34*a* including a cap 37, and a second sled 34*b* including one or more wipers 36, and a spittoon 38 for servicing printhead 18. First and second sleds 34*a* and 34*b* may move independently of one another during servicing of printhead 18.

Figure 2:
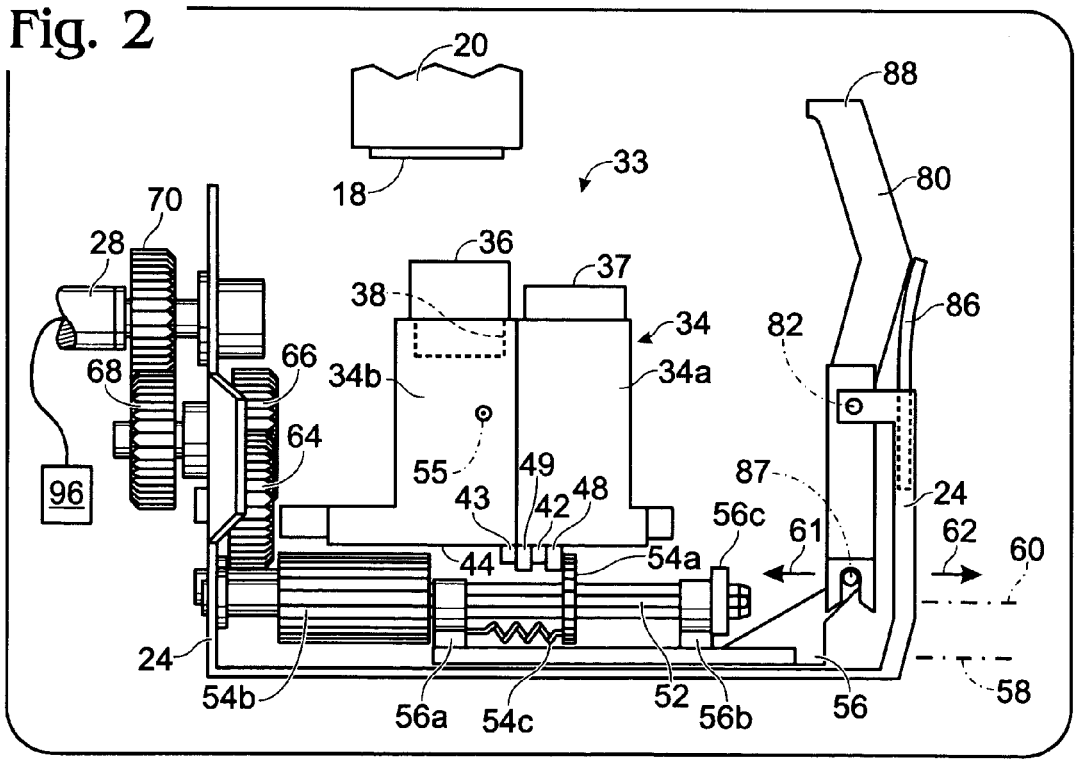
FIG. 2 is a detailed rear view of one embodiment of the printing mechanism viewed along line 2 of FIG. 1 wherein a servicing station sled is in a disengaged orientation.

FIG. 2 is a detailed rear view of one embodiment of the printing mechanism viewed alone line 2 of FIG. 1 wherein the servicing sleds 34*a* and 34*b* are in a disengaged orientation. In this embodiment, sleds 34*a* and 34*b* may further include one or more racks, including first and second racks 42 and 43 (both shown in end view), positioned on an underside 44 of sled 34, and a plurality of retaining walls, including first and second retaining walls 48 and 49 (both shown in end view), that may be positioned adjacent to and extending along racks 42 and 43. In the preferred embodiment, first rack 42 and retaining walls 48 and 49 may be positioned on first sled 34*a*, and second rack 43 may be positioned on second sled 34*b*. In other embodiments, other suitable numbers and positions of racks and retaining walls may be utilized on one or more sleds. A service station driveshaft 52, may be positioned adjacent to the racks and retaining walls wherein in the disengaged position as shown, retaining wall 48 may interfere with a first gear 54*a* of driveshaft 52 such that the driveshaft is not operable to translate first sled 34*a* along a sled translation axis 55 (shown in end view). First gear 54*a* of driveshaft 52 may be slidably secured on driveshaft 52 such that first gear 54*a* may slide along driveshaft 52 in either of directions 61 or 62. Driveshaft 52 may include a second gear 54*b* fixedly secured to driveshaft 52 such that second gear 54*b* may move with driveshaft 52. A biasing member, such as a coil spring 54*c*, may be secured at one end to driveshaft 52 adjacent to second gear 54*b*, or to an arm 56*a* of coupler 56, and at a second end to first gear 54*a* such that first gear 54*a* may be biased to move along driveshaft 52 toward second gear 54*b* in direction 61. In the disengaged position shown in FIG. 2, coil spring 54*c* is not in a tensioned or a compressed orientation such that the coil spring does not bias first gear 54*a* in direction 61.

Service station driveshaft 52 may be secured within a coupler 56 slidably secured to chassis 24 of printer housing 14 (see FIG. 1) for sliding movement of coupler 56 along a coupling axis 58. Sliding movement of coupler 56 back and forth along coupling axis 58 may actuate corresponding sliding movement of driveshaft 52 back and forth along a driveshaft axis 60. Driveshaft 52 may be fixedly secured within coupler 56 by arms 56*a* and 56*b* and collar 56*c* of coupler 56. In FIG. 2 as shown, driveshaft 52 and coupler 56 have been moved in direction 62 along axes 60 and 58, respectively, to a disengaged position wherein second gear 54*b* of driveshaft 52 may not engage an idler gear 64 secured to chassis 24.

Idler gear 64 may be rotatably secured to chassis 24 and may mate with a second idler gear 66. Second idler gear 66 may be rotatably secured to chassis 24 and to a third idler gear 68 such that idler gears 66 and 68 rotate together as one unit. Third idler gear 68 may mate with a power gear 70 which may be secured to feed roller drive shaft 28. In operation, rotation of feed roller drive shaft 28 may rotate power gear 70, which in turn may rotate idler gears 68 and 66, which in turn may rotate idler gear 64. In this disengaged orientation of drive shaft 52, wherein second gear 54*b* of driveshaft 52 may not mate with idler gear 64, rotation of idler gear 64 may not result in rotation of second gear 54*b* or driveshaft 52 connected thereto, such that first sled 34*a* may not be actuated for movement along sled axis 55.

Still referring to FIG. 2, servicing mechanism 33 may further include a shift arm 80 secured to chassis 24 at a shift arm pivot axis 82. Shift arm 80 may be biased into a non-actuated position, as shown in FIG. 2, by a leaf spring 86 secured within chassis 24 such that driveshaft 52 and coupler 56 are biased in direction 62 and into the disengaged position. Shift arm 80 may be connected to coupler 56 at a pivot 87.

Figure 3:
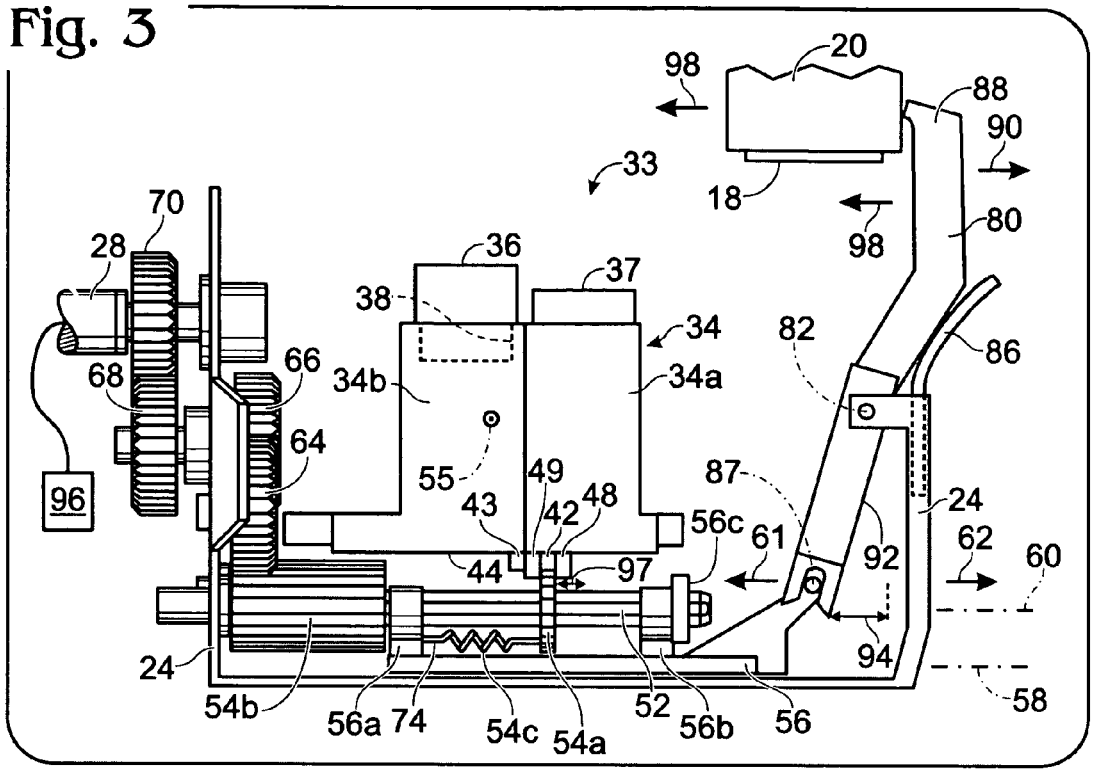
FIG. 3 is a detailed rear view of one embodiment of the printing mechanism viewed along line 2 of FIG. 1 wherein a servicing station sled is in a first engaged orientation.

FIG. 3 is a detailed rear view of one embodiment of the printing mechanism viewed along line 2 of FIG. 1 wherein driveshaft 52 is moved into a first engaged orientation. In particular, movement of an upper region 88 of shift arm 80 in a direction 90 by an external force greater than the biasing force of spring 86, such as the force exerted by movement of printhead carriage 20 in direction 90, may cause shift arm 80 to pivot about pivot axis 82, such that a lower region 92 of shift arm 80 may move in direction 61. Movement of lower region 92 of shift arm 80 in direction 61 a lateral distance 94 may cause coupler 56 and drive shaft 52 to move in direction 61 by a distance that corresponds to distance 94 such that second gear 54*b* of driveshaft 52 may be moved into engagement with idler gear 64. Movement of driveshaft 52 and second gear 54*b* secured thereto in direction 61 may cause a first end 74 of coil spring 54*c*, which may be secured to arm 56*a*, to also move in direction 61. Such movement of first end 74 of coil spring 54*c* in direction 61 may act to place coil spring 54*c* in a tensioned or stretched orientation such that coil spring 54*c* biases first gear 54*a* to move in direction 61 and into engagement with first rack 42 of first servicing sled 34*a*. Accordingly, first gear 54*a* may be positioned adjacent an end wall or an opening (see FIG. 5) in first retaining wall 48 such that first gear 54*a* may move past retaining wall 48 in direction 61 and into the first engaged position shown in FIG. 3 on rack 42 and adjacent and abutting second retaining wall 49.

Movement of first gear 54*a* in direction 61 from the disengaged position shown in FIG. 2 to the first engaged position shown in FIG. 3 may be through a lateral distance 97 which may be less than lateral distance 94 through which driveshaft 52 travels. Accordingly, in the first engaged position of first gear 54*a* as shown in FIG. 3, second retaining wall 49 may hinder further movement of first gear 54*a* in direction 61 such that coil spring 54*c* may be held in a stretched or tensioned orientation and first gear 54*a* may be retained on first rack 42.

In this first engaged or retained orientation of driveshaft 52, wherein first gear 54*a* is retained on first rack 42 of first sled 34*a*, first sled 34*a* may be actuated by a motor 96 (shown schematically), through gears 70, 68, 66 and 64, to move back and forth along sled translation axis 55. After first sled 34*a* is initially moved by motor 96 along sled translation axis 55, first gear 54*a* may be positioned adjacent a retaining region (see FIG. 5) of first retaining wall 48 such that first gear 54*a* may not be moved in direction 62 by shift arm 80. Accordingly, in this engaged orientation, first sled 34*a* may be actuated by motor 96 regardless of the position of printhead carriage 20. In other words, printhead carriage 20 may be moved in direction 98 out of contact with shift arm 80, and out of servicing region 32 if desired, while driveshaft 52 may remain engaged with idler gear 64 because first retaining wall 48 may hinder movement of driveshaft 52 in direction 62. The present invention, therefore, facilitates printhead carriage 20 initially engaging servicing first sled 34*a* by use of non-dedicated motor 96 without requiring printhead carriage 20 to remain in servicing region 32 or to remain in contact with shift arm 80 during servicing of printhead 18.

Rotation of drive shaft 28 may be in either a clockwise or a counter clockwise orientation which may result in a corresponding opposite rotation of driveshaft 52 and toothed sections 54*a* and 54*b* secured thereto. Of course, any suitable number of idler gears may be utilized such that rotation of drive shaft 28 may result in a corresponding, similar direction of rotation of driveshaft 52. Moreover, other sizes of idler gears may be utilized so as to result in differing speeds of rotation of feed roller drive shaft 28 and service station driveshaft 52. Rotation of driveshaft 52 and first gear 54*a*, while in contact with first rack 42, may cause servicing first sled 34*a* to move along sled translation axis 55 in a forward or a reverse direction, depending on the direction of rotation of drive shaft 28.

Still referring to FIG. 3, in the embodiment shown printhead carriage 20 may move upper region 88 of shift arm 80 in direction 90 to move drive shaft 28 into the engaged position, where after printhead carriage 20 is moved in direction 98 to a position over sled 34 for servicing. In another embodiment, not shown, printhead carriage 20 may be positioned over sled 34 while the printhead carriage 20 retains shift arm 80 in the engaged position.

Figure 4:
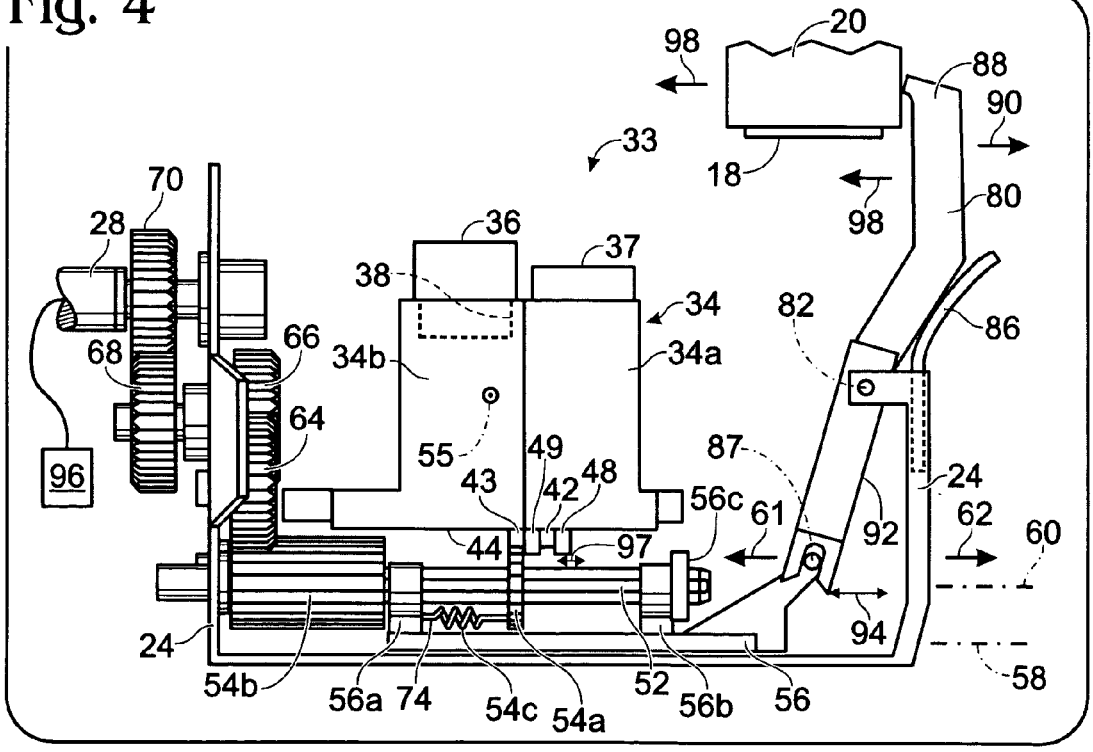
FIG. 4 is a detailed rear view of one embodiment of the printing mechanism viewed alone line 2 of FIG. 1 wherein a servicing station sled is in a second engaged orientation.

FIG. 4 is a detailed rear view of one embodiment of the printing mechanism viewed along line 2 of FIG. 1 wherein driveshaft 52 is moved into a second engaged orientation. In particular, movement of feed roller drive shaft 28 may rotate idler gears 70, 68, 66 and 64 thereby rotating first and second gears 54*a* and 54*b* and driveshaft 52. Rotation of driveshaft 52, which may cause first gear 54*a* to rotate on first rack 42, may cause first sled 34*a* to move along sled translation axis 55 in a forward or a rearward direction, depending on the rotational direction of drive shaft 28. Movement of first sled 34*a* along sled axis 55 may result in first gear 54*a* becoming aligned with an opening or end wall (see FIG. 5) of second retaining wall 49 such that coil spring 54*c* may bias first gear 54*a* to move in direction 61 toward second gear 54*b* and into engagement with second rack 43 on second sled 34*b*. Movement of first gear 54*a* into engagement with second rack 43 may move coil spring 54*c* into the non-tensioned orientation such that first gear 54*a* will remain on second rack 43.

Movement of first gear 54*a* into engagement with second rack 43 on second sled 34*b* may be accompanied by the presence of printhead carriage 20 at shift arm 80. Printhead carriage 20 may exert a force against upper region 88 of shift arm 80 in a direction 90 greater than the biasing force of spring 86, which may cause shift arm 80 to remain pivoted about pivot axis 82, such that a lower region 92 of shift arm 80 remains in the same position as in the first engaged position shown in FIG. 3. This allows movement of first gear 54*a* to move in direction 61 on driveshaft 52 and into engagement with second rack 43 while shift arm 80 retains driveshaft 52 in a stationary position.

Once first gear 54*a* is engaged with second rack 43, rotation of driveshaft 52 may move second sled 34*b* along sled axis 55 such that first gear 54*a* is positioned adjacent second retaining wall 49, such that second retaining wall 49 is positioned between first gear 54*a* and shift arm 80. Positioning of first gear 54*a* opposite shift arm 80 from second retaining wall 49 may act to hinder the biasing action of spring 86 such that first gear 54*a* may be retained on rack 43 after printhead carriage 20 is removed from engagement with shift arm 80. Accordingly, even though leaf spring 86 may bias upper region 88 of shift arm 80 to move in a direction 98, which thereby biases coupler 56 and driveshaft 52 to move in direction 62, second retaining wall 49 may retain driveshaft 52 in the second engaged position, so long as driveshaft 52 remains in a retaining section (see FIG. 5) of retaining wall 49. In this second engaged or retained orientation of driveshaft 52, second sled 34*b* may be actuated by motor 96 to move back and forth along sled translation axis 55 regardless of the position of printhead carriage 20. In other words, printhead carriage 20 may be moved in direction 98 out of contact with shift arm 80, and out of servicing region 32 if desired, while driveshaft 52 remains engaged with idler gear 64. The present invention, therefore, facilitates printhead carriage 20 periodically engaging servicing sleds 34*a* and 34*b* with non-dedicated motor 96, through gears 70, 68, 66 and 64, without requiring printhead carriage 20 to remain in servicing region 32 or to remain in contact with shift arm 80 during servicing of printhead 18.

Figure 5:
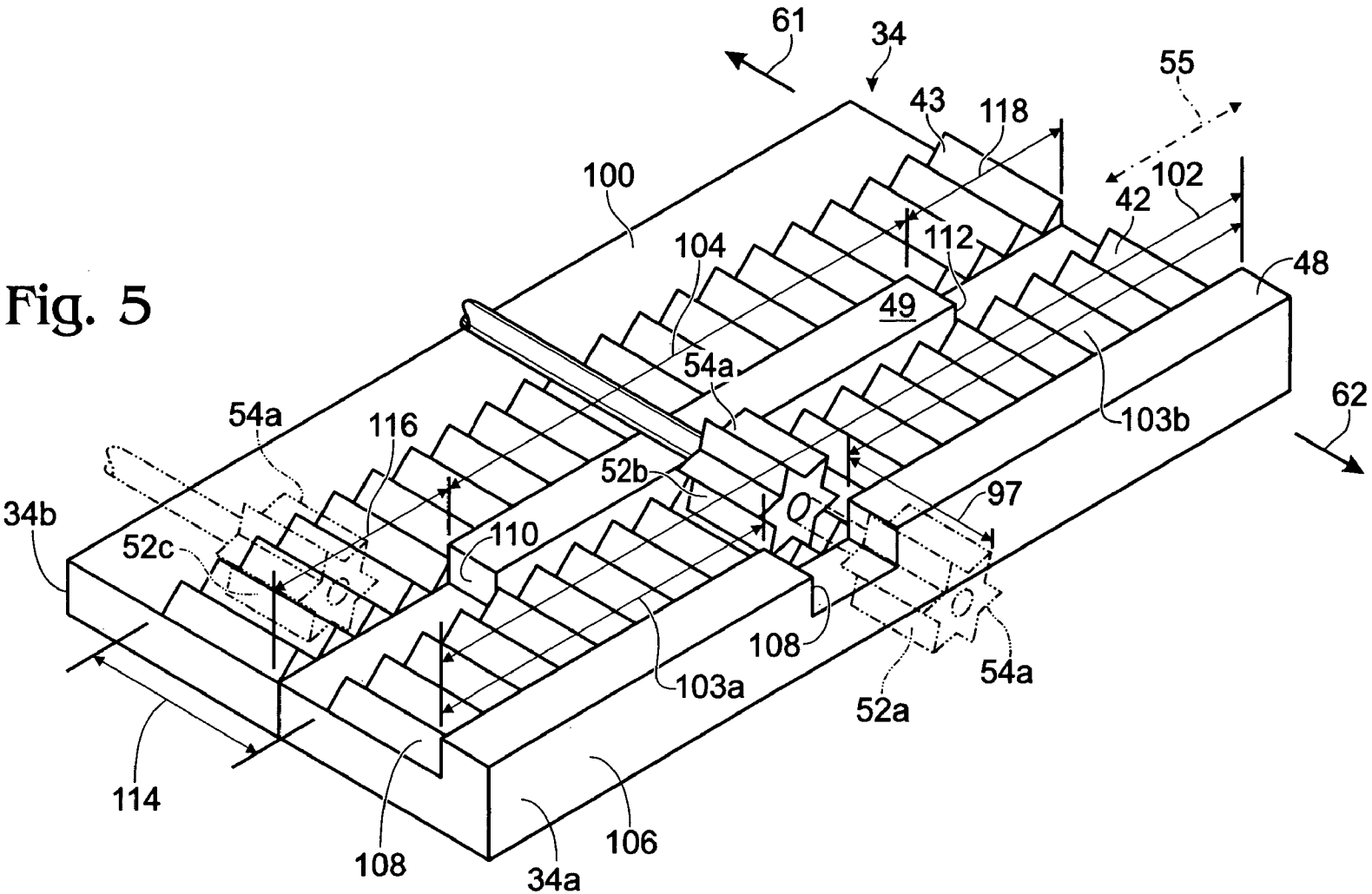
FIG. 5 is a detailed perspective bottom view of a servicing station sled showing a plurality of retaining walls on an underside thereof.

FIG. 5 is a detailed perspective bottom view of servicing sleds 34*a* and 34*b* showing first and second racks 42 and 43 and first and second retaining walls 48 and 49 on an underside 100 of the sleds, and showing first gear 54*a* of driveshaft 52 in three positions, namely, in a disengaged position 52*a* (shown in phantom and corresponding to FIG. 2), in a first engaged position 52*b* (corresponding to FIG. 3) and in a second engaged position 52*c* (shown in phantom and corresponding to FIG. 4). In FIG. 5, for ease of illustration, sleds 34*a* and 34*b* are turned upside down so that underside 100 of the sleds is shown facing upward. In the embodiment shown, racks 42 and 43 may each extend along the entirety or along a portion of length 102 of sleds 34*a* and 34*b* and retaining walls 48 and 49 may also each extend along a portion or portions of length 102 of sleds 34*a* and 34*b*, which may define the retaining region(s) for each of walls 48 and 49, respectively. In particular, first retaining wall 48 extends along sections 103*a* and 103*b* of length 102 of first sled 34*a*. Sections 103*a* and 103*b*, therefore, define the retaining regions 103*a* and 103*b* of first retaining wall 48 for the first engaged position 52*a* of first gear 54*a*. Second retaining wall 49 extends along section 104 of length 102 of first sled 34*a*. Section 104, therefore, defines the retaining region 104 of second retaining wall 49 for the second engaged position 52*b* of first gear 54*a*. In other embodiments other suitable lengths or orientations of racks 42 and 43, and other suitable lengths and orientations of retaining walls 48 and 49 may be utilized.

In retaining regions 103*a* and 103*b*, when first gear 54*a* is positioned on first rack 42, first retaining wall 48 may prevent first gear 54*a* from moving in direction 62 due to biased shift arm 80 (see FIG. 3) which may be connected to coupler 56. In retaining region 104, when first gear 54*a* is positioned on first rack 42, second retaining wall 49 may prevent first gear 54*a* from moving in direction 61 due to biased coil spring 54*c* (see FIG. 3) which may be connected to arm 56*a*. In retaining region 104, when first gear 54*a* is positioned on second rack 43, retaining wall 49 may prevent first gear 54*a* from moving in direction 62 due to biased shift arm 80 (see FIG. 4) which may be connected to coupler 56. The three positions of driveshaft 52 will now each be described in detail.

In disengaged position 52*a* (shown in phantom), first gear 54*a* of driveshaft 52 may be positioned adjacent a first side 106 of first retaining wall 48 and not in contact with first rack 42. Coil spring 54*c* (see FIG. 3) may be in a nominal, unstretched state. Second gear 54*b* (see FIG. 2) may not be in contact with idler gear 64 such that rotation of idler gear 64 (see FIG. 3) may not result in movement of first sled 34*a* along sled translation axis 55. Accordingly, in this disengaged position, first sled 34*a* is not operatively connected to or actuated by feed roller drive shaft 28 (see FIG. 2) and neither shift arm 80 nor coil spring 54*c* may be in a compressed or tensioned orientation.

In the first engaged position 52*b* (shown in solid lines), driveshaft 52 has been moved in direction 61 a distance 94 (see FIG. 3) such that second gear 54*b* (see FIG. 3) is moved in direction 61 a distance 94 and may engage idler gear 64, and such that first gear 54*a* may be moved in direction 61 a distance 97 through an opening 108 between sections 103*a* and 103*b* in first retaining wall 48. First gear 54*a* may move from the disengaged position 52*a* to the first engaged position 52*b* through distance 97 in direction 61 which may be less than distance 94 traveled by driveshaft 52. Accordingly, in this first engaged position 52*b*, coil spring 54*c* (see FIG. 3) may bias first gear 54*a* in direction 61. However, retaining section 104 of second retaining wall 49 may be aligned with opening 108 such that second retaining wall 49 may prevent first gear 54*a* from moving further in direction 61. Second retaining wall 49, therefore, retains first gear 54*a* in the first engaged position on first rack 42 in retaining region 104.

To move first gear 54*a* to second engaged position 52*c* (shown in phantom), drive shaft 28 (see FIG. 3) may be to rotated to actuate rotation of idler gear 64 (see FIG. 3), which in turn may rotate second gear 54*b*, drive shaft 52 and first gear 54*a*, which may move first sled 34*a* along sled axis 55 such that first gear 54*a* may be moved along first rack 42 past an end wall 110 or 112 of second retaining wall 49. Once first gear 54*a* passes end wall 110 or 112 along first rack 42, such that second retaining wall 49 may not retain first gear 54*a* on first rack 42, coil spring 54*c* may bias first gear 54*a* to move in direction 61 and onto second rack 43 on second sled 34*b*. Movement of first gear 54*a* from first rack 42 to second rack 43 may be through a distance 114 wherein distance 97 and distance 114 are equal to distance 94, the distance through which drive shaft 52 moves in response to pivotal movement by shift arm 80 (see FIG. 3). Accordingly, in the second engaged position 52*c* of first gear 54*a*, coil spring 54*c* (see FIG. 3) may be unbiased such that first gear 54*a* remains on second rack 43. Once first gear 54*a* is positioned on second rack 43, rotation of drive shaft 28 may actuate rotation of idler gear 64, and thereby rotate first gear 54*a*, thereby moving second sled 34*b* along sled axis 55.

First engaged position 52*b*, wherein first sled 34*a* is engaged and second engaged position 52*c*, wherein second sled 34*b* is engaged, may be utilized to perform different functions. For example, rotation of first gear 54*a* while engaged with first rack 42, so as to cause movement of first sled 34*a* while first gear 54*a* is retained in retaining portion 104 of second retaining wall 49 and along first rack 42, may be used to position first sled 34*a* for capping of printhead 18 (see FIG. 1). Rotation of first gear 54*a* while engaged with second rack 43, so as to cause movement of second sled 34*b*, may be used for wiping printhead 18, scraping of wiper(s) 36, and spitting of printhead 18 (see FIG. 1) into spittoon 38. Accordingly, the servicing mechanism of the present invention may utilize a single gear 54*a* and a non-dedicated motor 96 for actuating a variety of servicing functions wherein a driveshaft may be indexed between a plurality of engaged positions on a plurality of sleds by the biasing force of biasing members and the particular positioning of retaining walls and openings therein. In other embodiments, a plurality of sleds and/or a plurality of retaining walls and racks each having a suitable number of positions or openings may be utilized for a variety of applications wherein the driveshaft and/or the gear may be moved into different engagement positions on the plurality of sleds, retaining walls and racks.

Figure 6C:
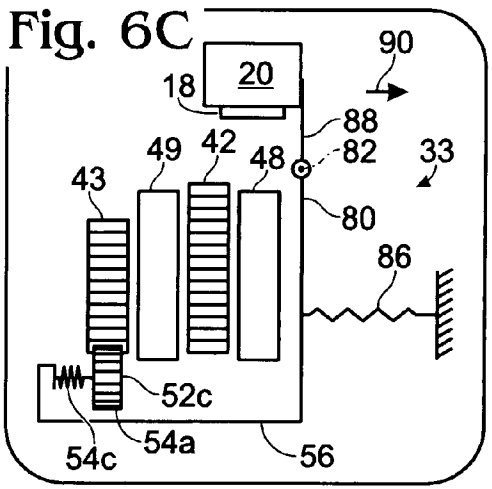
FIGS. 6 and 7 are schematic views of another embodiment of the printing mechanism of the present invention.
Figure 6B:
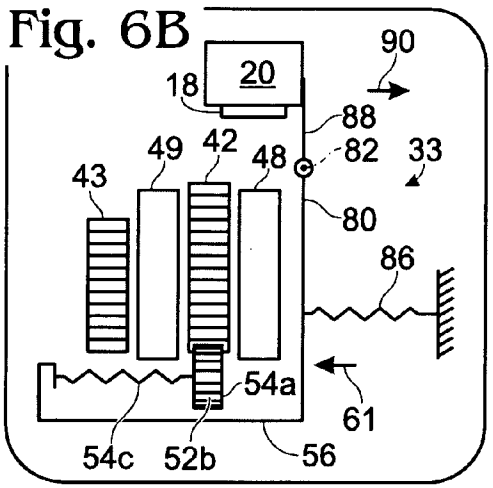
Figure 6A:
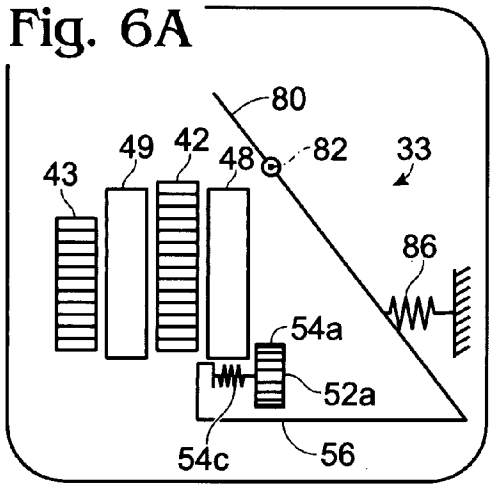
Figure 7C:
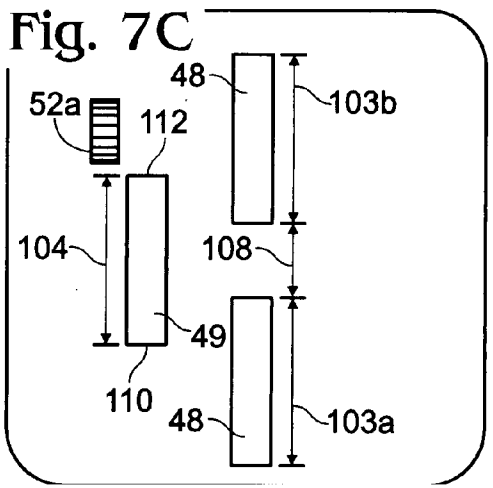
Figure 7B:
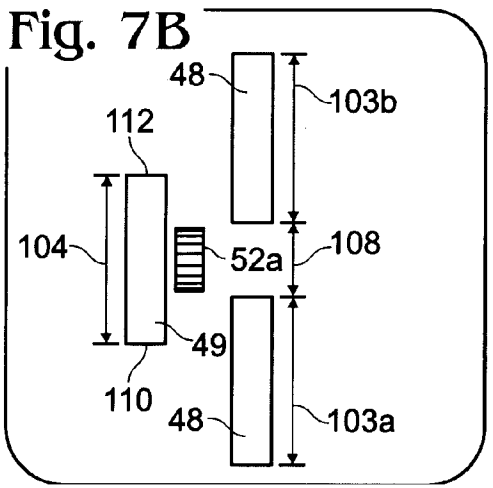
Figure 7A:
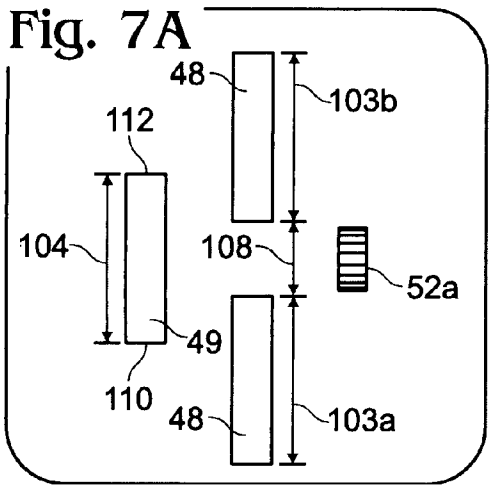

FIGS. 6 and 7 show front and top schematic views (the gears are not shown in the top views of FIGS. 7A-7C), respectively, of another embodiment wherein servicing mechanism 33 may comprise a plurality of rotating gears 42 and 43 (instead of racks) positioned adjacent retaining walls 48 and 49. Similar reference numbers are used to refer to the components of servicing mechanism 33 in FIGS. 6-7 that correspond to the reference numbers used for the embodiment of the servicing mechanism shown in FIGS. 3-5. In the embodiment shown in FIGS. 6-7, first and second gears 42 and 43 may be utilized to actuate different servicing functions or may be utilized to actuate different slewing speeds of a servicing sled or sleds (see FIG. 3). For example, first gear 42 may have a first diameter, and second gear 43 may have a second diameter, wherein the diameter of first gear 42 may be larger than the diameter of second gear 43 such that first gear 42 may actuate a relatively slow movement of first sled 34*a*, which may be utilized for capping printhead 18, and such that second gear 43 may actuate a relatively fast movement of second sled 34*b*, which may be utilized for moving sled 34 out of servicing region 32 after servicing of the printhead or for other servicing functions such as wiping or spitting. In yet another embodiment, gears 42 and 43 may each have a similar diameter but may be connected to gear train mechanisms each having different diameter gears so as to achieve differing slewing speeds of servicing sleds 34*a* and 34*b*. As still another example, first gear 42 may be actuated to move a sled in a horizontal direction, such as for wiping of printhead 18 (see FIG. 1), wherein second gear 43 may be actuated to move a sled in a vertical direction, such as for capping of printhead 18. The individual figures will now be described.

FIGS. 6A and 7A show front and top schematic views, respectively, of a disengaged position of servicing mechanism 33 wherein shift arm 80 may not be moved by an external force such as that exerted by printhead carriage 20. In this position, a pinion 52*a* may not be in contact with gears 42 or 43 or retaining walls 48 and 49, and a coil spring 54*c* may be in an un-stretched and unbiased orientation. In this disengaged position motor 96 (see FIG. 2) does not actuate movement of a sled along axis 55 (see FIG. 2) wherein pinion 52*a* may be retained against movement in direction 90 by first retaining wall 48 and may be retained against movement in direction 61 by second retaining wall 49.

FIGS. 6B and 7B show front and top schematic views, respectively, of a first engaged position of servicing mechanism 33 wherein a top section 88 of shift arm 80 may be moved in direction 90, or held in the same position as shown in FIG. 6B, by an external force such as that exerted by printhead carriage 20. In this position, pinion 52*a* may be moved through an opening in first retaining wall 48 and into contact with first gear 42, and coil spring 54*c* may be in a stretched and biased orientation wherein second wall 49 hinders further movement of pinion 52*a* in direction 61. In this first engaged position motor 96 (see FIG. 2) may actuate movement of a sled along axis 55 (see FIG. 2) wherein pinion 52*a* may be retained against movement in direction 90 by second retaining wall 49.

FIGS. 6C and 7C show front and top schematic views, respectively, of a second engaged position of servicing mechanism 33 wherein a top section 88 of shift arm 80 may be moved or held in direction 90 by an external force such as printhead carriage 20. In this position, pinion 52*a* may be moved around an end wall of second retaining wall 49 and into contact with second gear 43, and coil spring 54*c* may be moved into an un-stretched and unbiased orientation. In this second engaged position motor 96 (see FIG. 2) may actuate movement of a sled along axis 55 (see FIG. 2).

Figure 8:
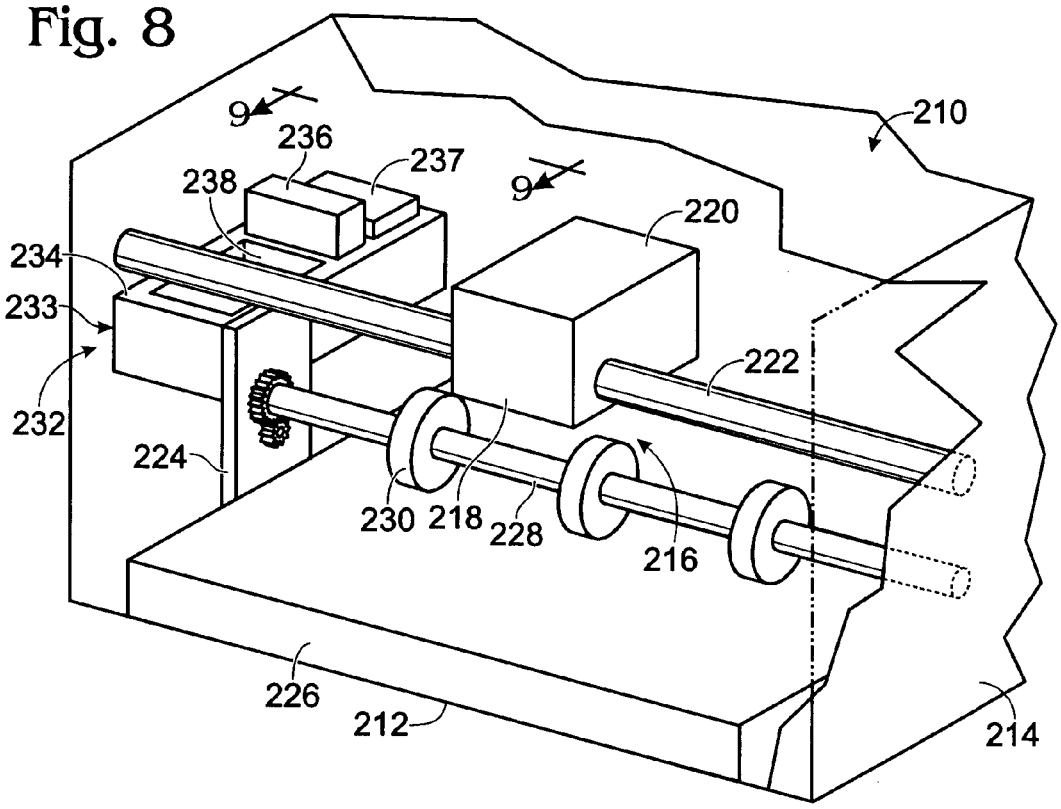
FIG. 8 is a front perspective view of one form of a printing mechanism including one embodiment of the printhead servicing mechanism of the present invention.

FIG. 8 illustrates one embodiment of a printing mechanism. The printing mechanism may be used for the printing of business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience, the concepts of example embodiments of the present invention are illustrated in the environment of an inkjet printer 210. However, other printing mechanisms may include embodiments of the present printhead servicing mechanisms.

While the printer's components may vary, printer 210 may include a base 212 surrounded by a housing 214. Base 212 may be manufactured of steel or the like whereas housing 214 may be manufactured of a plastic material. Sheets of print media may be fed through a printzone 216 to a printhead 218 which may be supported by a printhead carriage 220. Printhead carriage 220 may be movably mounted on a carriage rod 222 for movement there along, wherein carriage rod 222 may be mounted on a chassis 224 which may be secured to base 212. In this figure, printhead carriage 220 is shown positioned in printzone 216. The print media may be any type of suitable material, such as paper, card-stock, transparencies, mylar, and the like, but for convenience, the illustrated embodiment is described using a sheet of paper as the print medium. The printer 210 may include a feed tray 226 for storing sheets of print media before printing thereon. One or more motor-driven drive shafts 228, which may have one or more drive rollers 230 mounted thereon, may be used to move the print media from tray 226 into printzone 216 for printing. During operation of printer 210, printhead 218 may be moved into a servicing region 232 which may include a printhead servicing mechanism 233 including a servicing sled 234. Sled 234 may include one or more wipers 236, a cap 237 and a spittoon 238 for servicing printhead 218.

Figure 9:
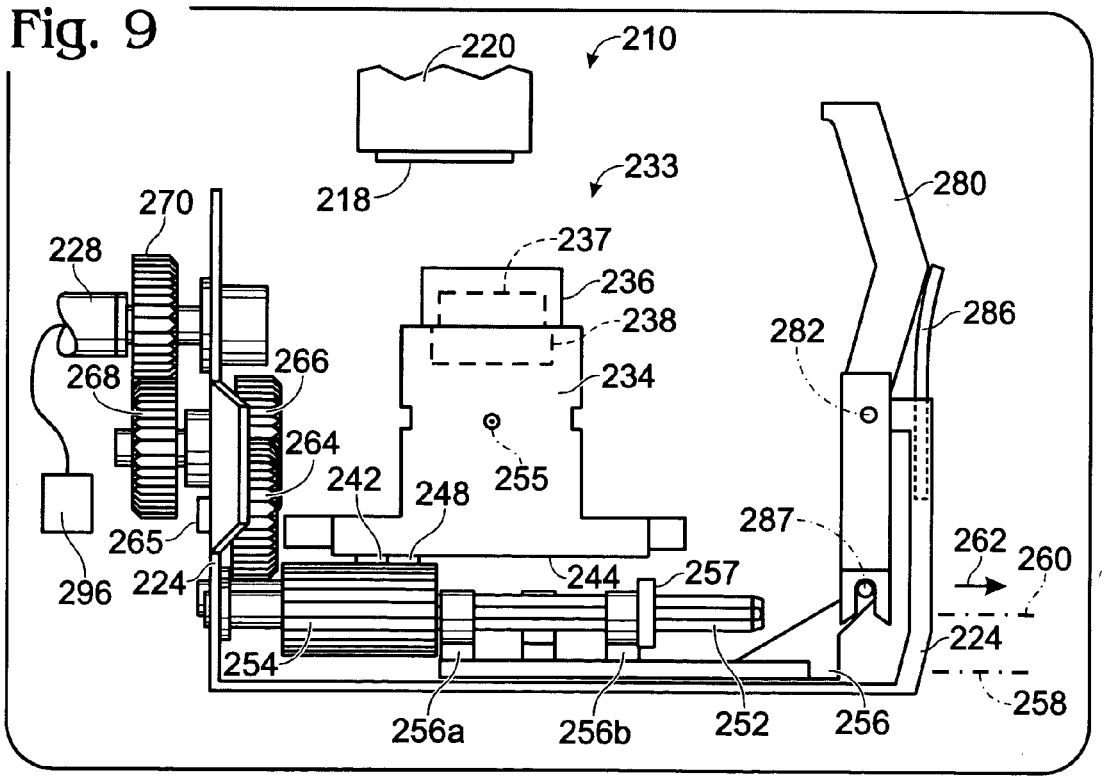
FIG. 9 is a detailed rear view of one embodiment of the printhead servicing mechanism viewed along line 9 of FIG. 8 wherein a servicing station sled is in a disengaged orientation.

FIG. 9 is a detailed rear view of one embodiment of the printhead servicing mechanism viewed along line 9 of FIG. 8 wherein the servicing sled 234 is in a disengaged orientation. In this embodiment, sled 234 may further include a rack 242 (shown in end view) positioned on an underside 244 of sled 234, and a retaining wall 248 (shown in end view), that may be positioned adjacent to and extending along rack 242. A service station driveshaft 252, may be positioned adjacent to rack 242 wherein in the disengaged position as shown, retaining wall 248 interferes with a toothed section 254 of driveshaft 252 such that the driveshaft is not operable to translate sled 234 along a sled translation axis 255 (shown in end view).

Service station driveshaft 252 may be secured within a coupler 256 slidably secured to chassis 224 of printer housing 214 (see FIG. 8) for sliding movement of coupler 256 along a coupling axis 258. Sliding movement of coupler 256 back and forth along coupling axis 258 may actuate corresponding sliding movement of driveshaft 252 back and forth along a driveshaft axis 260. Drive shaft 252 may be fixedly secured within coupler 256 wherein toothed section 254 of driveshaft 252 may abut an arm 256*a* of coupler 256 and wherein a collar 257 may be secured on driveshaft 252 adjacent a second arm 256*b* of coupler 256. Positioning of arms 256*a* and 256*b* between toothed section 254 and collar 257 may fixedly retain driveshaft 252 on coupler 256. In FIG. 9 as shown, driveshaft 252 and coupler 256 have been moved in a direction 262 along axis 260 to a disengaged position wherein toothed section 254 of driveshaft 252 may not engage an idler gear 264 secured by a rod 265 to chassis 224.

Idler gear 264 may be rotatably secured to chassis 224 and rod 265 and may mate with a second idler gear 266. Second idler gear 266 may be rotatably secured to chassis 224 and to a third idler gear 268 such that idler gears 266 and 268 rotate together as one unit. Third idler gear 268 may mate with a power gear 270 which may be secured to a power shaft, such as feed roller drive shaft 228. In operation, rotation of feed roller drive shaft 228 may rotate power gear 270, which in turn may rotate idler gears 268 and 266, which in turn may rotate idler gear 264. In this disengaged orientation of drive shaft 252, wherein toothed section 254 of driveshaft 252 does not mate with idler gear 264, rotation of idler gear 264 may not result in rotation of toothed section 254 or driveshaft 252, connected thereto.

Still referring to FIG. 9, servicing mechanism 233 may further include a shift arm 280 secured to chassis 224 at a shift arm pivot axis 282. Shift arm 280 may be biased into a non-actuated position, as shown in FIG. 9, by a leaf spring 286 secured within chassis 224. Shift arm 280 may be secured to coupler 256 at a pivot 287.

Figure 10:
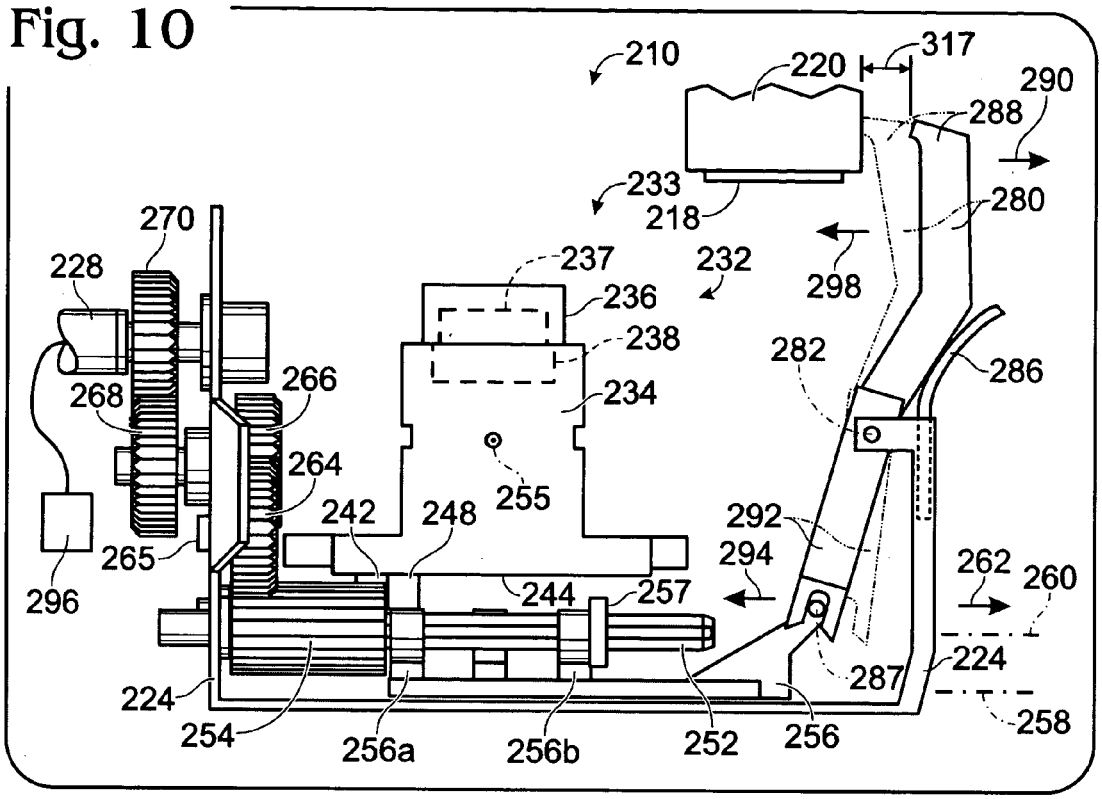
FIG. 10 is a detailed rear view of one embodiment of the printhead servicing mechanism viewed along line 9 of FIG. 8 wherein a servicing station sled is in an engaged orientation.

FIG. 10 is a detailed rear view of one embodiment of the printhead servicing mechanism viewed along line 9 of FIG. 8 wherein driveshaft 252 is moved into an engaged orientation. In particular, movement of an upper region 288 of shift arm 280 in a direction 290 by an external force greater than the biasing force of spring 286, such as the force exerted by movement of printhead carriage 220 in direction 290, may cause shift arm 280 to pivot about pivot 282, such that a lower region 292 of shift arm 280 may move in a direction 294. Lower region 292 of shift arm 280 generally moves through an arc about pivot axis 282. However, such movement in direction 294, due to the relatively short distance of the arcuate movement, is shown as linear movement for ease of illustration. Movement of lower region 292 of shift arm 280 in direction 294 may cause coupler 256 and driveshaft 252 to move in direction 294 such that toothed section 254 of driveshaft 252 may be moved into simultaneous engagement with idler gear 264 and rack 242 of servicing sled 234 and such that toothed section 254 is not aligned with retaining wall 248. Thereafter, rotation of feed roller drive shaft 228 by a motor 296 (shown schematically) may result in rotation of gears 270, 268, 266 and 264, and toothed section 254, thereby rotating driveshaft 252. Rotation of drive shaft 228 may be in either a clockwise or a counter clockwise orientation which may result in a corresponding opposite rotation of driveshaft 252. Of course, any suitable number of idler gears may be utilized such that rotation of drive shaft 228 may result in a corresponding, similar direction of rotation of driveshaft 252. Moreover, other sizes of idler gears than shown may be utilized so as to result in differing speeds of rotation of feed roller drive shaft 228 and service station driveshaft 252. Rotation of driveshaft 252, while in contact with rack 242, may cause servicing sled 234 to move along sled translation axis 255 (see FIG. 11) in a forward direction into the page or a reverse direction out of the page, depending on the direction of rotation of drive shaft 228. Accordingly, movement of printhead carriage 220 against shift arm 280 may actuate non-dedicated motor 296 to power servicing sled 234 to service printhead 218.

In FIG. 10 as shown, driveshaft 252 may be in contact with rack 242 and may be positioned adjacent and abutting retaining wall 248. Retaining wall 248 may be positioned on sled 234 such that in the engaged orientation as shown, retaining wall 248 prevents driveshaft 252 and coupler 256 from moving in direction 262. Accordingly, even though leaf spring 286 may bias upper region 288 of shift arm 280 to move in a direction 298, which thereby may bias coupler 256 and driveshaft 252 to move in direction 262, retaining wall 248 may retain driveshaft 252 in the engaged position, so long as toothed section 254 of driveshaft 252 remains in a predetermined zone of engagement of retaining wall 248, as will be described with reference to FIG. 11. In this engaged or retained orientation of driveshaft 252, sled 234 may be actuated by motor 296 to move back and forth along sled translation axis 255 regardless of the position of printhead carriage 220. In other words, printhead carriage 220 may be moved in direction 298 out of contact with shift arm 280, and out of servicing region 232 if desired, while driveshaft 252 remains engaged with idler gear 264. The present invention, therefore, facilitates printhead carriage 220 initially engaging servicing sled 234 with non-dedicated motor 296 without requiring printhead carriage 220 to remain in servicing region 232 or to remain in contact with shift arm 280 during servicing of printhead 218. The dash line and solid line positions of shift arm 280 will be described in more detail with respect to FIG. 11.

Still referring to FIG. 10, in the embodiment shown printhead carriage 220 may move upper region 288 of shift arm 280 in direction 290 to move drive shaft 228 into the engaged position, where after printhead carriage 220 is moved in direction 298 to a position over sled 234 for servicing. In another embodiment, not shown, printhead carriage 220 may be positioned over sled 234 while the printhead carriage 220 retains shift arm 280 in the engaged position.

Figure 11:
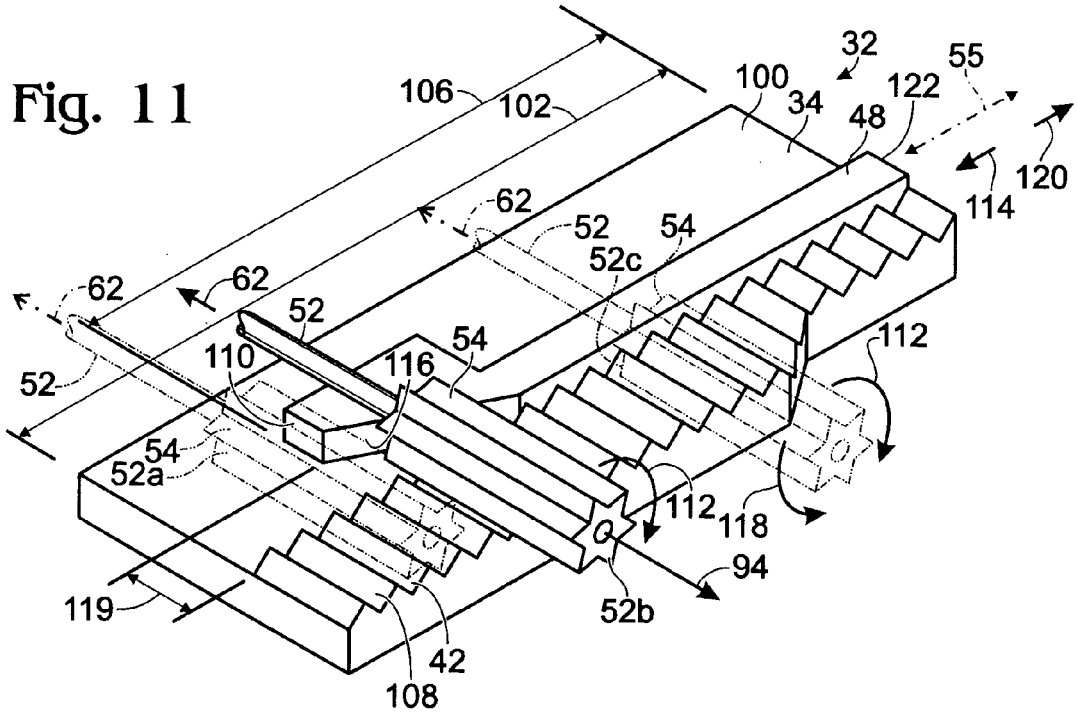
FIG. 11 is a detailed perspective bottom view of a servicing station sled showing a retaining wall on an underside thereof.

FIG. 11 is a detailed perspective bottom view of servicing sled 234 showing retaining wall 248 on an underside 300 thereof and showing toothed region 254 of driveshaft 252 in three positions, namely, in a disengaged position 252*a*, in an initially engaged position 252*b* and in a fully engaged position 252*c*. In this figure, for ease of illustration, sled 234 is turned upside down so that underside 300 of sled 234 is shown facing upward. In the embodiment shown, rack 242 may extend along a length 302 of sled 234 and retaining wall 248 may extend along a portion 304 of length 302 of sled 234. In other embodiments other lengths or orientations of rack 242 and retaining wall 248 may be utilized. A portion of sled 234 through which retaining wall 248 may extend may be referred to as a predetermined zone of engagement 306 of sled 234. In zone of engagement 306, retaining wall 248 may prevent driveshaft 252 from moving in direction 262 due to biased shift arm 280 (see FIG. 10) which may be connected to coupler 256 (see FIG. 10). The three positions of driveshaft 252 will now each be described.

In disengaged position 252*a* (shown in phantom), toothed region 254 of driveshaft 252 is not in contact with idler gear 264 (see FIG. 9). Accordingly, in this disengaged position, driveshaft 252 may not be rotated by idler gear 264 (see FIG. 10) and may not result in movement of sled 234 along sled translation axis 255. Moreover, in the disengaged position as shown, an end wall 310 of retaining wall 248 may abut drive shaft 252 thereby hindering movement of sled 234 along translation axis 255. End wall 310, therefore, may act as a locking feature, preventing movement of sled 234 when the sled is not engaged.

In the initially engaged position 252*b*, driveshaft 252 has been moved in direction 294 such that toothed region 254 of driveshaft 252 has cleared end wall 310 and may be in contact with idler gear 264 (see FIG. 10) and with teeth 308 of rack 242. In the initially engaged position 252*b* shown, drive shaft 252 may also have been rotated in a direction 312 by idler gear 264 (see FIG. 10) such that sled 234 has moved in a direction 314 along sled translation axis 255. In this initial section of retaining wall 248, wall 248 may include a ramped or an angled section 316 such that as driveshaft 252 rotates in direction 312, ramped section 316 may force driveshaft 252 slightly further in direction 294. This initially engaged position, wherein printhead carriage 220 engages upper section 288 of shift arm 280, and wherein toothed section 254 of driveshaft 252 first engages angled section 316, is shown in dash lines in FIG. 10.

Referring now to FIGS. 10 and 11, movement of driveshaft 252 slightly further in direction 294, due to ramped section 316, as driveshaft 252 rotates in direction 312 may result in coupler 256 and lower region 292 of shift arm 280 also being moved slightly further in direction 294. Movement of lower region 292 of shift arm 280 in direction 294 may result in movement of upper region 288 of shift arm 280 in direction 290 about pivot axis 282. Accordingly, due to ramped section 316, if printhead carriage 220 remains stationary after initially engaging shift arm 280, upper region 288 of shift arm 280 may be moved slightly in direction 290 such that retaining wall 248 will bear the force of spring 286, rather than such force remaining in position against printhead carriage 220. In other words, there may be a slight clearance 317, which may correspond to the depth 319 of ramp 316, between printhead carriage 220 and the upper region 288 of shift arm 280 due to ramped section 316. Ramped section 316 of retaining wall 248, therefore, may reduce the force exerted against printhead carriage 220 during servicing of the printhead 218, which may reduce the power requirements of motor 296 that actuates movement of printhead carriage 220. Moreover, reducing the force exerted against printhead carriage 220 during servicing of the printhead may increase the life of the printer by reducing alignment problems that may be associated with retaining printhead carriage 220 in position against spring 286 during servicing or for extended periods of time.

Referring still to FIG. 11, further rotation of driveshaft 252 in direction 312 may result in driveshaft 252 being moved in a direction 320 into the fully engaged position 252*c* (shown in phantom) on rack 248 past ramped section 316 of retaining wall 248. In this fully engaged position, wherein toothed section 254 of driveshaft 252 mates with idler gear 264 (see FIG. 10) and with teeth 308 of rack 242, rotation of driveshaft 252 in either of directions 312 or 318, while retaining toothed region 254 of driveshaft 252 in predetermined zone of engagement 306, may result in corresponding movement of sled 234 in either of directions 314 or 320. This fully engaged position 252*c* of sled 234 may be referred to as an independently engaged orientation of sled 234 in that the sled may be engaged with motor 296 for movement of the sled, without requiring the continued presence of printhead carriage 220 against shift arm 288 (see FIG. 10). Sled 234 may perform servicing functions, such as scraping of wipers 236 (see FIG. 8) for example, without printhead carriage 220 being present in servicing region 232. Removal of printhead carriage 220 from servicing region 232 during scraping may prevent flicked ink from contaminating printhead 218 and may allow printhead carriage 220 to be moved into other regions of the printer for completion of other printhead functions while sled 234 is actuated to move throughout servicing region 232. Further movement of driveshaft 252 in either of directions 312 or 318 may result in sled 234 being moved with respect to driveshaft 252 such that toothed region 254 of driveshaft 252 is removed from predetermined zone of engagement 306. In other words, sled 234 may be moved to a position where toothed region 254 is no longer retained on rack 242 by retaining wall 248. Removal of driveshaft 252 from its engaged position against retaining wall 248, either by movement past end wall 310 in direction 314 or movement past second end wall 322 in direction 320, will allow biased shift arm 280 (see FIG. 10) to move driveshaft 252 in direction 262 and into a disengaged position 252*a* wherein toothed region 254 of driveshaft 252 no longer engages idler gear 264. Once again, in this disengaged position, sled 234 may be prevented from moving by endwall 310, or by endwall 322, which may be positioned abutting toothed region 254 of driveshaft 252. Accordingly, servicing mechanism 233 may be referred to as self-disengaging.

Still referring to FIG. 11, rotation of driveshaft 252 in direction 318 may cause sled 234 to move in direction 320 such that retaining wall 248 is moved in direction 320. During continued movement of sled 234 in direction 320, as toothed region 254 contacts ramped section 316, printhead carriage 220 may be positioned against shift arm 280 (see FIG. 10) so as to retain toothed section 254 on rack 242 and idler gear 264 as toothed section 254 is moved past endwall 310 in direction 314. In other words, printhead carriage 220 may be positioned against shift arm 280 so as to counter act the biasing force on driveshaft 252 by spring 286 once toothed section 254 is no longer retained in engagement with idler gear 264 by retaining wall 48.

Figure 12:
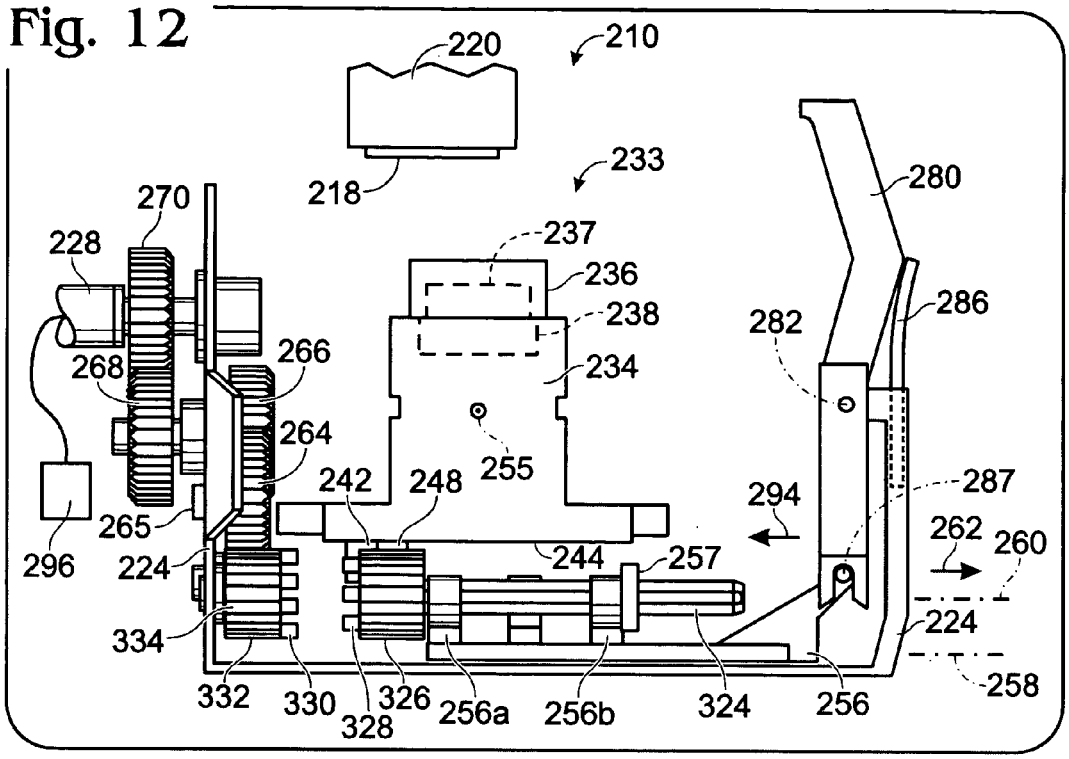
FIG. 12 is a detailed rear view of another embodiment of a service station drive shaft.

FIG. 12 is a detailed rear view of another embodiment of a service station drive shaft. In this embodiment, a drive shaft 324 may comprise a toothed section 326 having projections 328 that mate with projections 330 of a toothed section 332 of a gear 334 aligned along driveshaft axis 260 and engaged with idler gear 264. In this embodiment, movement of coupler 256 and driveshaft 324 in direction 294 may result in toothed section 326 mating with toothed section 332 along axis 260 so as to power sled 234.

Figure 13:
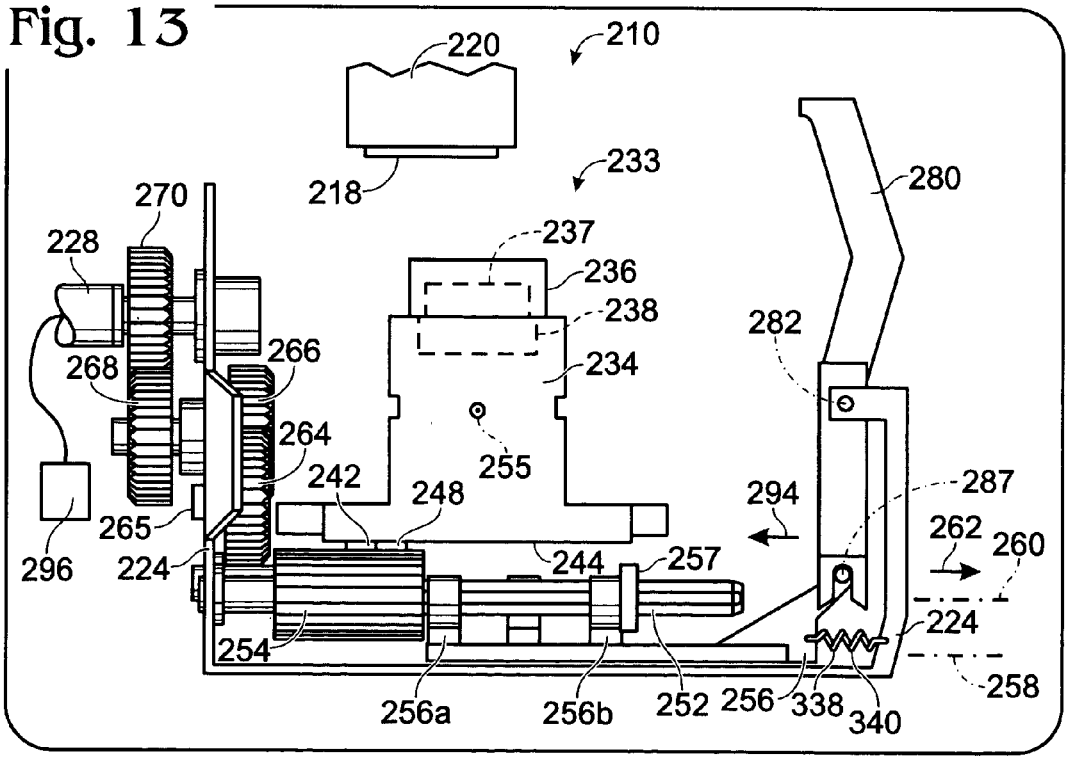
FIG. 13 is a detailed rear view of another embodiment of a biasing member.

FIG. 13 is a detailed rear view of another embodiment of a biasing member. In this embodiment a coil spring 340 may not be connected to shift arm 280 but may be connected directly to coupler 256. In this embodiment, shift arm 280 may move coupler 256 in either of directions 262 and 294, whereas coil spring 340, in the absence of other external forces, may bias coupler 256 and driveshaft 252 to move in direction 262. In another embodiment, a biasing member 338 may be positioned between shift arm 280 and chassis 224.

Figure 14:
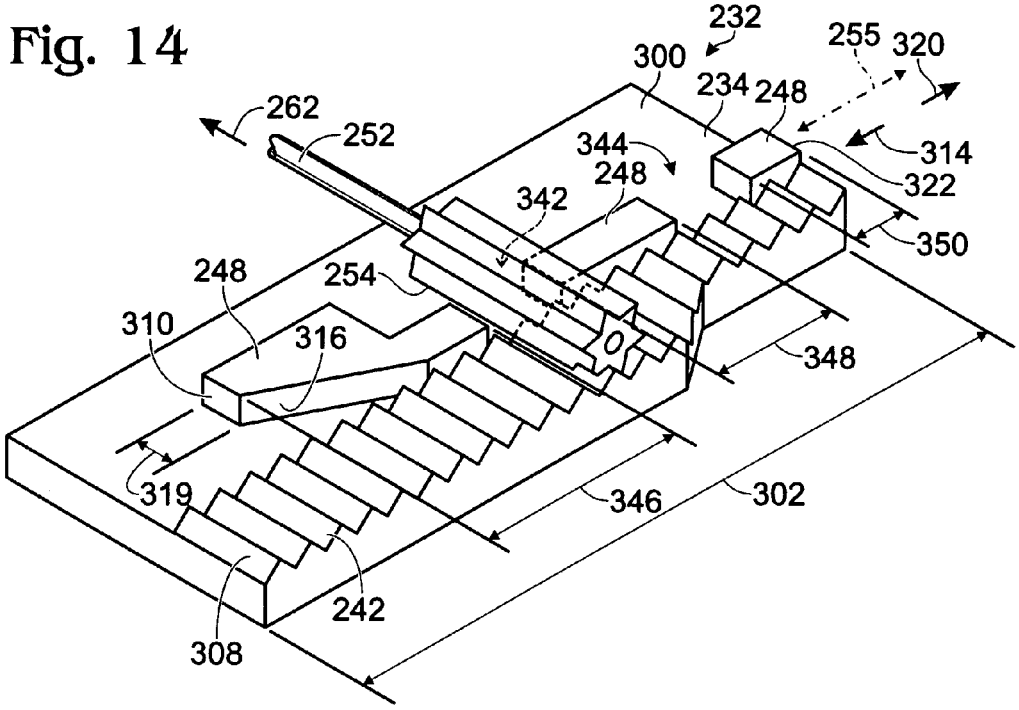
FIG. 14 is a detailed perspective view of another embodiment of a retaining wall including several cutout regions on an underside of a servicing sled.

FIG. 14 is a detailed bottom view of another embodiment of a sled 234 wherein retaining wall 248 may include several cutout regions 342 and 344 which may allow driveshaft 252 to be biased in direction 262 and out of engagement with idler gear 264 (see FIG. 10). Of course, any suitable number and/or location of a cutout region(s) may be utilized in retaining wall 248 for a particular application. In this embodiment, the predetermined zone of engagement may extend through regions 346, 348 and 350.

Figure 15:
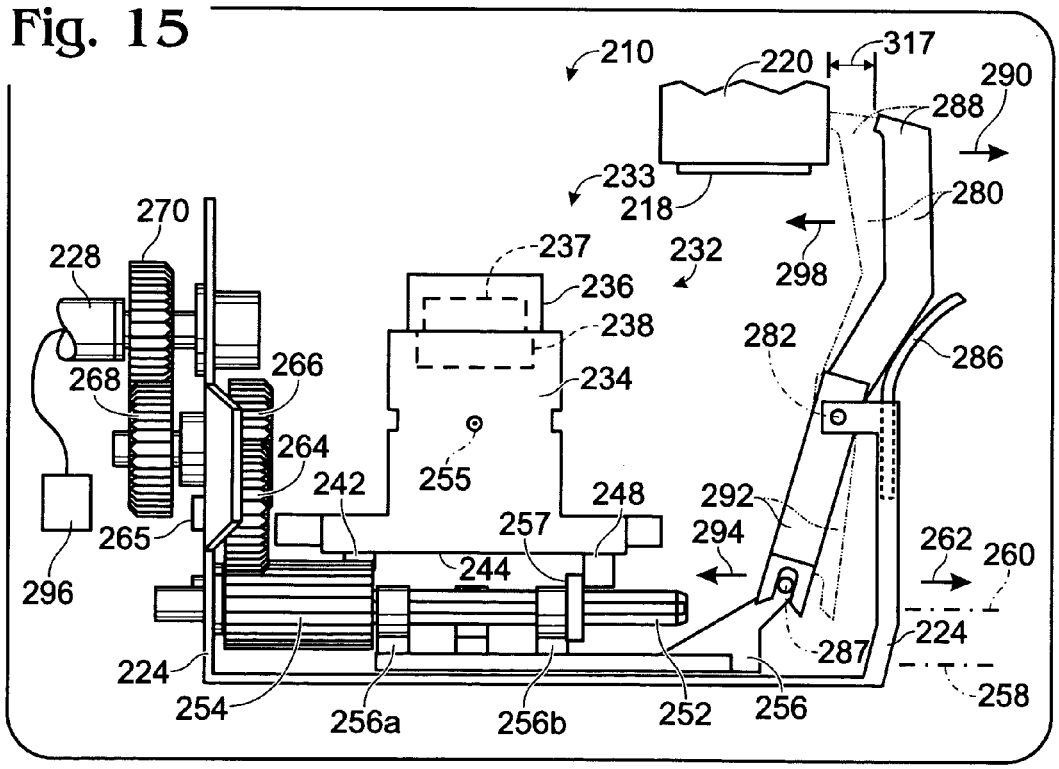
FIG. 15 is a detailed rear view of another embodiment of a printhead servicing mechanism.

FIG. 15 is a detailed rear view of another embodiment of a printhead servicing mechanism wherein retaining wall 248 is not positioned against rack 242 but is instead positioned adjacent collar 257 of driveshaft 252 when driveshaft 252 is in the engaged position. In this embodiment, collar 257 may be retained on retaining wall 248 so as to retain toothed region 254 of driveshaft 252 in engagement with idler gear 264. In other embodiments, toothed region 254, wall 248 and rack 242 may be positioned in different locations as desired for particular applications.

Other enhancements may be made to the servicing mechanism wherein such variations and modifications of the concepts described herein fall within the scope of the claims below.

We claim:

1. A printhead servicing mechanism, comprising:

an axially movable driveshaft including a gear; and a sled including first and second engagement structures each adapted to selectively engage said gear and a retaining structure positioned between said first and second engagement structures.

2. A printhead servicing mechanism according to claim 1 wherein said driveshaft is shiftable between a disengaged position and an engaged position wherein said gear engages one of said engagement structures.

3. A printhead servicing mechanism according to claim 2 wherein when said driveshaft is in the engaged position said gear is shiftable between a first engaged position and a second engaged position, wherein said gear in the first engaged position engages said first engagement structure and wherein said gear in the second engaged position engages said second engagement structure.

4. A printhead servicing mechanism according to claim 3 wherein said driveshaft further includes a biasing member that biases said gear from said first engaged position to said second engaged position.

5. A printhead servicing mechanism according to claim 4 wherein when said gear is in said first engaged position and in a retaining portion of said retaining structure, said retaining structure retains said gear on said first engagement structure.

6. A printhead servicing mechanism according to claim 5 wherein said first engagement structure comprises a first rack, said second engagement structure comprises a second rack and said retaining structure comprises a retaining wall positioned therebetween, and said retaining wall comprising first and second end walls with said retaining portion extending therebetween.

7. A printhead servicing mechanism according to claim 2 wherein said driveshaft in the engaged position is operatively connected to a power shaft that transmits power to said driveshaft.

8. A printhead servicing mechanism according to claim 7 further comprising a motor that drives said power shaft.

9. A printhead servicing mechanism according to claim 2 further comprising a shift structure operatively connected to said driveshaft and moving between an engaged position and a disengaged position, wherein movement of said shift structure from said disengaged position to said engaged position moves said driveshaft from said disengaged position to said engaged position.

10. A printhead servicing mechanism according to claim 9 wherein said shift structure includes a biasing element that biases said shift arm into said disengaged position.

11. A printhead servicing mechanism according to claim 10 further comprising a printhead cartridge that overcomes said biasing element on said shift arm and moves said shift structure from said disengaged position to said engaged position.

12. A printhead servicing mechanism according to claim 1 wherein said sled includes a first sled including said first engagement structure and a cap, and a second sled including said second engagement structure and a wiper and a spittoon, wherein said first and second sleds are operable for movement independent of one another.

13. A printhead servicing mechanism according to claim 1 further comprising a biasing member coupled to said driveshaft for biasing the driveshaft out of engagement with said first and second engagement structures.

14. A printer comprising:

first and second sleds, said first sled including a first engagement structure and first and second retaining walls positioned on opposite sides of said first engagement structure, and said second sled including a second engagement structure positioned adjacent said second retaining wall;

a servicing station drive structure movable between a disengaged position, a first engaged position, and a second engaged position, said drive structure in the first engaged position engaging said first engagement structure and said drive structure in the second engaged position engaging said second engagement structure; and a biasing member that biases said servicing station drive structure to move from said first engaged position to said second engaged position.

15. A printer according to claim 14 wherein said first retaining wall includes an access region, said drive structure moving through said access region when said drive structure is moved from the disengaged position to the first engaged position.

16. A printer according to claim 14 wherein said second retaining wall includes an access region, said drive structure moving through said access region when said drive structure is moved from the first engaged position to the second engaged position.

17. A printer according to claim 14 further comprising a biasing member that biases said drive structure to move from the first engaged position to the disengaged position, said first retaining wall including a retaining region that retains said drive structure in said first engaged position and against biased movement to said disengaged position when said drive structure is positioned within said retaining region.

18. A printer according to claim 17 further comprising:

a shift arm that pivots between an actuated position and a non-actuated position, wherein pivotal movement of said shift structure from the non-actuated position to the actuated position moves said drive structure from the disengaged position to the first engaged position, wherein said biasing member biases said shift arm to pivot from the actuated position to the non-actuated position; and a printhead carriage operable to pivot said shift arm from the non-actuated position to the actuated position by overcoming a biasing force of said biasing member.

19. A printer according to claim 14 further comprising a biasing member that biases said drive structure to move from the first engaged position to the second engaged position, said second retaining wall including a retaining region that retains said drive structure in said first engaged position when said drive structure is positioned within said retaining region.

20. A printer according to claim 14 wherein in the disengaged position said servicing station drive structure is not in contact with either of said first and second engagement structures, wherein in the first engaged position said servicing station drive structure is powered by a power shaft and mates with said first engagement structure to translate said first servicing sled parallel to a sled translation axis, and wherein in the second engaged position said servicing station drive structure is powered by said power shaft and mates with said second engagement structure to translate said second servicing sled parallel to said sled translation axis.

21. A printing mechanism including a printhead, comprising:

means for servicing said printhead, said means for servicing including means for retaining and first and second means for engaging; and means for translating said means for servicing said printhead, said means for translating operable to move from a first translating position in engagement with said first means for engaging to a second translating position in engagement with said second means for engaging, wherein said means for retaining includes a retaining region, and wherein said means for retaining retains said means for translating in said first translating position when said means for translating is positioned within said retaining region.

22. A printing mechanism according to claim 21 further comprising means for shifting said means for translating between a disengaged position and said first translating position, said means for shifting biased to shift said means for translating into said disengaged position in the absence of an external force on said means for shifting.

23. A printing mechanism according to claim 22 wherein said means for servicing comprises first and second servicing sleds, said means for retaining comprises a retaining wall positioned on said first sled, said first and second means for engaging comprise, respectively, first and second racks each extending along said retaining wall, said first rack positioned on said first sled and said second rack positioned on said second sled, said means for translating comprises a driveshaft, and said means for shifting comprises a shift arm including a leaf spring, a first end adapted for contact with said printhead, and a second end secured to said driveshaft.

24. A printing mechanism according to claim 21 wherein said printhead is configured to selectively actuate said means for shifting by advancing into and out of contact with said means for shifting.

25. A method of actuating a servicing mechanism to service a printhead, comprising:

translating a translation device into engagement and contact with a retaining region of a first servicing mechanism;

powering said translation device such that said first servicing mechanism is moved with respect to said translation device to translate the retaining region such that said translation device is positioned out of said retaining region;

translating said translation device into engagement and contact with a second region of a second servicing mechanism; and powering said translation device such that said second servicing mechanism is moved with respect to said translation device.

26. A method according to claim 25 wherein the step of translating the translation device into engagement with the first servicing mechanism comprises moving a printhead carriage into contact with an actuation device so as to move the actuation device from a non-actuated position to an actuated position, wherein movement of said actuation device from said non-actuated position to said actuated position moves said translation device from a disengaged position into engagement with said first servicing mechanism.

27. A method according to claim 26, prior to translating said translation device into engagement with the second servicing mechanism, further comprising:

removing said printhead carriage from contact with said actuation device, whereafter a retaining wall of said retaining region retains said translation device in engagement with said first servicing mechanism in said retaining region.

28. A method according to claim 25 wherein said step of powering said translation device such that said translation device is positioned out of said retaining region comprises:

powering said translation device such that said first servicing mechanism is moved with respect to said translation device such that said translation device is moved into an access region of said first servicing mechanism; and moving said translation device through said access region of said first servicing mechanism.

29. A method according to claim 28 wherein said translation device is biased by a biasing member to move through said access region of said first servicing mechanism.

30. A printer comprising:

a housing;

a printhead carriage positioned within said housing and supporting a printhead for movement along a printhead carriage axis between a printzone and a servicing region;

a feed roller drive shaft operable to move a sheet of print media through said printzone;

a servicing sled positioned within said servicing region and including a spittoon, a wiper, a cap, first and second racks and a guide wall positioned between said racks, said guide wall including a retaining region and an access region; and a servicing sled drive shaft powered by said feed roller drive shaft, said servicing sled drive shaft including a gear slidably mounted thereon, and a biasing member secured to said shaft and said gear, said servicing sled drive shaft movable between a disengaged position wherein said gear is not in contact with said servicing sled and an engaged position wherein said gear is movable between contact with said first rack and second rack, wherein said biasing member biases said gear to move from said first rack to said second rack when said gear is aligned with said access region of said guide wall and wherein said retaining wall retains said gear on said first rack when said gear is positioned adjacent said retaining region of said guide wall.

31. A printhead servicing mechanism, comprising:

a driveshaft carrying a pinion gear; and a sled including a rack gear, wherein the driveshaft is axially shiftable from a disengaged position in which the pinion gear is out of contact with the rack gear to an engaged position in which the pinion gear is in meshing contact with the rack gear; and a retaining wall positioned to retain said driveshaft on said rack gear in a zone.

32. A printhead servicing mechanism according to claim 31 wherein said driveshaft is shiftable between a disengaged position and an engaged position wherein said driveshaft engages a powered gear and said rack.

33. A printhead servicing mechanism according to claim 32 wherein said powered gear is operatively connected to a power shaft that, when said driveshaft is in the engaged position, said powered gear transmits power to said driveshaft.

34. A printhead servicing mechanism according to claim 33 wherein said powered gear is an idler gear and wherein said power shaft transmits power to said driveshaft through said idler gear.

35. A printhead servicing mechanism according to claim 34 further comprising a shift arm that moves between an engaged position and a disengaged position, wherein movement of said shift arm from said disengaged position to said engaged position moves said driveshaft into engagement with said idler gear and said rack.

36. A printhead servicing mechanism according to claim 35 further comprising a printhead carriage that moves said shift arm from said disengaged position to said engaged position.

37. A printhead servicing mechanism according to claim 36 wherein said retaining wall includes a first region and a second region, wherein powering of said driveshaft moves said driveshaft from said first region to said second region of said rack, and wherein movement of said driveshaft from said first region to said second region of said rack moves said shift arm out of engagement with said printhead carriage.

38. A printhead servicing mechanism according to claim 31 wherein said sled further includes a cap, a wiper and a spittoon.

39. A printhead servicing mechanism according to claim 31 further comprising a biasing member coupled to said driveshaft for biasing the driveshaft out of engagement with said rack.

40. A printhead servicing mechanism according to claim 32 wherein when said driveshaft is in said disengaged position said retaining wall interferes with said driveshaft thereby preventing movement of said sled.

41. A printhead servicing mechanism according to claim 33 further comprising a motor that drives said power shaft.

42. A printhead servicing mechanism according to claim 34 wherein said driveshaft includes projections, and said idler gear includes projections, and wherein in the engaged position said projections of said driveshaft mate with said projections of said idler gear.

43. A printhead servicing mechanism according to claim 36 wherein said shift arm includes a biasing element that biases said shift arm to move said driveshaft into said disengaged position when said driveshaft is not positioned in said zone of said retaining wall.

44. A printer comprising:

a sled including an engagement structure and a retaining structure;

a power shaft that transmits power to a driveshaft; and the driveshaft movable between an engaged position and a disengaged position, said driveshaft in the engaged position engaging said power shaft and said engagement structure of said sled so as to transmit power from said power shaft to said sled, wherein said sled retaining structure retains said driveshaft in said engaged position in a predetermined zone of said retaining structure.

45. A printer according to claim 44 further comprising a shift mechanism that moves between an actuated position and a non-actuated position, wherein movement of said shift mechanism from the non-actuated position to the actuated position moves said driveshaft from the disengaged position to the engaged position.

46. A printer according to claim 45 further comprising a printhead carriage movable between an engaged position and a disengaged position, wherein movement of said printhead carriage from the disengaged position to the engaged position moves said shift mechanism from the non-actuated position to the actuated position.

47. A printer according to claim 45 wherein said shift mechanism comprises a shift arm including a biasing member, said biasing member biasing said shift arm into the non-actuated position in the absence of an external force on said shift arm.

48. A printing mechanism including a printhead, comprising:

means for translating a means for servicing said printhead, said means for translating biased to move from a translating position to a non-translating position out of contact with the means for servicing; and the means for servicing said printhead, said means for servicing including means for retaining said means for translating in engagement and contact with said means for servicing in a predetermined zone of engagement of said means for retaining; and comprising means for shifting said means for translating between said translating position and said non-translating position, said means for shifting biased to translate said means for translating into said disengaged position in the absence of an external force on said means for shifting, wherein said means for servicing comprises a servicing sled including a rack that extends along a length of said sled, said means for retaining comprises a guide wall positioned adjacent to and extending along at least a portion of said rack, said means for translating comprises a driveshaft that engages a powered gear and said rack and is retained on said rack by said guide wall in said translating position, and said means for shifting comprises a shift arm including a leaf spring, a first end adapted for contact with said printhead, and a second end secured to said driveshaft.

49. A printing mechanism according to claim 48 wherein said printhead is configured to selectively actuate said means for shifting by advancing into and out of contact with said means for shifting.

50. A printing mechanism according to claim 48 further comprising means for powering said means for translating, wherein said means for translating engages said means for servicing and said means for powering in said translating position.

51. A method of actuating a servicing mechanism to service a printhead, comprising:

translating a translation device into engagement with a first region of a servicing mechanism; and powering said translation device such that said servicing mechanism is moved with respect to said translation device and such that a second region of said servicing mechanism is moved into engagement with said translation device, said second region retaining said translation device in contact with said servicing mechanism, wherein said step of translating the translation device comprises moving a printhead carriage into contact with an actuation device so as to move the actuation device from a non-actuated condition to an actuated condition, wherein movement of said actuation device from said non-actuated position to said actuated position moves said translation device from a disengaged position into engagement with said first region of said servicing mechanism;

removing said printhead carriage from contact with said actuation device, whereafter said translation device remains engaged with said servicing mechanism while said translation device is in contact with said second region of said servicing mechanism, and thereafter, translating said servicing mechanism, such that said second region is moved with respect to said translation device, to service said printhead in the absence of said printhead carriage.

52. A method according to claim 51 further comprising translating said servicing mechanism such that said second region of said servicing mechanism is moved out of contact with said translation device, whereupon said translation device is biased into said disengaged position.

* * * * *